US010674876B2

(12) United States Patent
Larsson et al.

(10) Patent No.: US 10,674,876 B2
(45) Date of Patent: Jun. 9, 2020

(54) DISPENSER FOR STORING AND DISPENSING HYGIENE PRODUCTS

(71) Applicant: SCA Hygiene Products AB, Göteborg (SE)

(72) Inventors: Björn Larsson, Billdal (SE); Peter Orgna, Göteborg (SE)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 19 days.

(21) Appl. No.: 14/890,716

(22) PCT Filed: May 17, 2013

(86) PCT No.: PCT/SE2013/050559
§ 371 (c)(1),
(2) Date: Nov. 12, 2015

(87) PCT Pub. No.: WO2014/185843
PCT Pub. Date: Nov. 20, 2014

(65) Prior Publication Data
US 2016/0113448 A1 Apr. 28, 2016

(51) Int. Cl.
*A47K 5/12* (2006.01)
*A47K 10/34* (2006.01)
(Continued)

(52) U.S. Cl.
CPC ..... *A47K 5/12* (2013.01); *A47K 10/24* (2013.01); *A47K 2010/3233* (2013.01)

(58) Field of Classification Search
CPC .. A47K 5/12; A47K 10/34; A47K 2010/3233; B65D 83/0805
See application file for complete search history.

(56) References Cited

U.S. PATENT DOCUMENTS 3,249,273 A * 5/1966 Robinson ..... A47K 10/3827 225/16
3,387,902 A * 6/1968 Perrin ..... A47K 10/24 242/560.3
(Continued)

FOREIGN PATENT DOCUMENTS

CN 2352469 Y 12/1999
CN 1595023 A 3/2005
(Continued)

OTHER PUBLICATIONS

Russian Decision on Grant dated Mar. 21, 2017 issued in counterpart Russian patent application No. 2015153823 (12 pages) and its English-language translation thereof (5 pages).
(Continued)

*Primary Examiner* — Gene O Crawford
*Assistant Examiner* — Kelvin L Randall, Jr.
(74) *Attorney, Agent, or Firm* — Faegre Drinker Biddle & Reath LLP

(57) ABSTRACT

An inventive dispenser for storing and dispensing hygiene products is disclosed. The dispenser includes, in a closed state, a rear wall, two opposite side walls, a front wall, and an upper wall. The dispenser further includes a dispensing opening and an openable cover that may be opened for refill of the dispenser. At least one wall of the dispenser includes a support structure made at least mainly of plastic material. An outer thin metal sheet is laminated to an exterior surface of the support structure, and the surface of the metal sheet includes a curved surface in at least one direction.

30 Claims, 8 Drawing Sheets

(51) Int. Cl.
*A47K 10/24* (2006.01)
*A47K 10/32* (2006.01)

(56) References Cited

U.S. PATENT DOCUMENTS 4,707,038 A * 11/1987 Voegeli ..... G07F 11/045 221/226
5,772,291 A 6/1998 Byrd et al.
6,062,422 A * 5/2000 Ellis ..... A47K 10/3827 221/45
7,044,329 B2 * 5/2006 Lum ..... A47F 9/042 206/554
7,172,092 B2 * 2/2007 Yang ..... A47F 9/042 206/449
7,837,077 B2 11/2010 Formon et al.
8,256,644 B2 * 9/2012 Orgna ..... A47K 5/1202 221/45
8,561,837 B2 * 10/2013 Giammanco ..... A47K 10/46 221/102
9,445,694 B2 * 9/2016 Ophardt ..... A47K 5/12
2005/0016230 A1 * 1/2005 Lum ..... A47F 9/042 70/159
2005/0199641 A1 * 9/2005 Yang ..... A47F 9/042 221/1
2006/0237459 A1 10/2006 Lepera
2007/0257058 A1 * 11/2007 Ophardt ..... A47K 5/12 222/129
2007/0257061 A1 * 11/2007 Ophardt ..... A47K 5/12 222/181.3
2008/0257906 A1 * 10/2008 Orgna ..... A47K 5/1202 221/303
2009/0250484 A1 10/2009 Kling et al.
2009/0277920 A1 11/2009 Cittadino et al.
2011/0024414 A1 2/2011 Widmer
2011/0297694 A1 * 12/2011 Conway ..... A47K 10/421 221/46
2011/0315707 A1 * 12/2011 Kleinhuber ..... A47K 10/421 221/155
2012/0048892 A1 * 3/2012 van der Heijden .... A47K 5/122 222/162
2012/0261436 A1 * 10/2012 Farrell ..... A47K 10/3836 221/199
2014/0014675 A1 * 1/2014 Ingvarsson ..... A47K 5/06 221/155
2016/0051095 A1 * 2/2016 Ophardt ..... A47K 5/12 222/173

FOREIGN PATENT DOCUMENTS

CN 1809307 A 7/2006
CN 101189166 A 5/2008
CN 101267757 A 9/2008
CN 101325899 A 12/2008
CN 102421346 A 4/2012
DE 102010002465 A1 9/2011
GB 964809 A 7/1964
RU 2382589 C2 2/2010
WO WO-2007/35139 A1 3/2007
WO WO-2011/002361 A1 1/2011

OTHER PUBLICATIONS

First Chinese Office Action dated May 14, 2018 issued in corresponding Chinese patent application No. 201380076645.7 (9 pages) and its English-language translation thereof (11 pages).
Third Chinese Office Action dated Aug. 1, 2019 issued in corresponding Chinese patent application No. 201380076645.7 (8 pages) and its English-language translation thereof (11 pages).

* cited by examiner

FIG. 7 A-A

DISPENSER FOR STORING AND DISPENSING HYGIENE PRODUCTS

CROSS-REFERENCE TO PRIOR APPLICATION

This application is a § 371 National Stage Application of PCT International Application No. PCT/SE2013/050559 filed May 17, 2013, which is incorporated herein in its entirety.

TECHNICAL FIELD

The present disclosure relates to a dispenser for storing and dispensing hygiene products. The dispenser includes, in a closed state, a rear wall, two opposite side walls, a front wall and an upper wall, the dispenser further includes a dispensing opening and an openable cover that may be opened for refill of the dispenser. The present disclosure also relates to a method for manufacturing such a dispenser.

BACKGROUND ART

There is a general desire to provide dispensers having a robust design and an aesthetical appearance while still having a low manufacturing cost. Dispensers made of injection-moulded plastic material have the benefit of enabling relatively low manufacturing cost, low weight and a large freedom in terms of the design of the dispenser, such as complex three dimensional shaping, but plastic dispensers are generally perceived as less robust and of lower quality. Dispensers made of metal material, such as stainless steel, are generally perceived as robust and of high quality but have a relatively high manufacturing cost. Attempts have been to form dispensers made of mixed plastic and metal materials, such as for example shown in WO2007/035139, where front and upper sections are made of metal sheet and the rest of the dispenser is made of plastic material. It is also known for example from U.S. Pat. No. 7,837,077 to provide a dispenser cover and/or body portion to be made from metalized or metal-plated plastic material. None of the known solutions have however solved the problem of providing a dispenser having a robust design, an aesthetical appearance while still having a low manufacturing cost.

There is thus a need for an improved dispenser removing the above mentioned problem.

SUMMARY

It is desired to provide a dispenser for dispensing a hygiene product where the previously mentioned problem is at least partly avoided.

Disclosed is a dispenser for storing and dispensing hygiene products. The dispenser includes, in a closed state, a rear wall, two opposite side walls, a front wall and an upper wall. The dispenser further includes a dispensing opening and an openable cover that may be opened for refill of the dispenser.

At least one wall of the dispenser includes a support structure made at least mainly of plastic material, an outer thin metal sheet is laminated to an exterior surface of the support structure, and the metal sheet includes a curved surface in at least one direction.

Lamination of a thin metal sheet to plastic support structure of a dispenser enables a dispenser having a perceived robust design and an aesthetica) appearance due to the outer metal sheet finish of the dispenser. The thin metal sheet will exhibit the same visual appearance as a metal dispenser but without incurring the high cost and high weight associated with metal dispensers. Forming the inner content of the dispenser of plastic material also enables many advantages in terms of manufacturing costs and weight.

Furthermore, by forming the metal sheet with at least one curved surface the risk of having a non-continuous surface reflection in the laminated metal sheet is reduced. Surface reflection is herein referred to as the image a user may see reflected in the surface of the dispenser, and non-continuous surface reflection corresponds to a reflected image having non-continuous distortions. Plastic material always suffers from a certain degree of crimping during the solidification phase after moulding. The crimping of the plastic material is taken into account before manufacturing the tools for manufacturing the plastic parts of the dispenser, but full certainty is never possible with respect to the form and shape of the final product. A completely flat plastic support structure would thus after manufacturing not always exhibit a completely flat surface, and a relatively thin metal sheet laminated to the plastic support surface would then exhibit a substantially flat surface but with one or more deviations from the flat state. Such deviations are easily registered by any person observing the surface and generally perceived as negative and gives an impression of low quality. One solution for avoiding such non-continuous surface reflection is to form the plastic support structure already from the outset with a certain curvature. Thereby, small deviations from the desired curvature due to varying crimping effects have less impact on the surface reflection, which may still be perceived as more or less continuous. The curvature may be cylindrical with a fixed and/or varying radius of curvature for enabling manufacturing by means of metal rolling, which is a relatively fast and efficient manufacturing method, and which also enables forming of single piece metal sheets covering three or more side walls of the dispenser. The metal sheet may alternatively at any point have a surface curvature in all directions.

Also disclosed is a method for manufacturing a dispenser having the advantages described above. The method includes:

forming a dispenser made mainly of plastic material, wherein the dispenser includes, in a closed state, a rear wall, two opposite side walls, a front wall, an upper wall, a dispensing opening and an openable cover that may be opened for refill of the dispenser, wherein at least one wall of the dispenser includes a support structure made mainly of plastic material, cutting and forming a metal sheet, such that the metal sheet includes a curved surface in at least one direction, and laminating the metal sheet on an exterior surface of the support structure.

Further advantages are achieved by implementing one or several of the features of the dependent claims.

The metal sheet may extend continuously over part of at least two neighbouring walls of the dispenser, for example the front wall and the upper wall of the dispenser. The metal sheet may even extend continuously over part of at least three consecutive walls of the dispenser, and for example over part of at least four consecutive walls of the dispenser. A single uninterrupted metal sheet stretching over at least two neighbouring walls, alternatively over three consecutive walls or even over four consecutive walls of the dispenser enhances the perception of a solid and robust dispenser design, as well as simplifies the assembly of the dispenser since less separate metal sheets must be laminated to the support structure separately The walls may be at least the front wall and the two side walls, or the front wall, the upper wall and a lower wall.

The exterior surface of the metal sheet may have a relatively large radius of curvature in a centre region of the walls, and relatively small radius of curvature in the region between neighbouring wall sections. The dispenser will, unless it exhibits a cylindrical or spherical shape, have a more or less rectangular shape with flattened sidewalls meeting at more curved intersecting regions.

The exterior surface of the metal sheet in the region of the walls may have a radius of curvature in the range of 500-15 000 millimetres, or in the range of 1000-12 000 millimetres, or in the range of 4000-8000 millimetres. This relatively large radius of curvature, which may be perceived as substantially flat by an observer, is associated with the central regions of the side walls of the dispenser, which side walls are mutually joined at intersecting regions. The fact that the side walls are not flat but exhibit a certain level of curvature prevents non-continuous reflections in the surface of the metal sheet.

The exterior surface of the metal sheet in the region between neighbouring wall sections may have a radius of curvature in the range of 5-200 millimetres, or in the range of 10-130 millimetres, or in the range of 30-80 millimetres. The intersecting regions where side walls of the dispenser meet exhibit a relatively large radius of curvature for accomplishing the rectangular shape of the dispenser.

The visible exterior surface of the metal sheet may be free from discrete changes in radius of curvature. Discrete changes in radius of curvature refer to a non-continuous radius of curvature and are associated with non-continuous reflections in the surface of the metal sheet, thereby generating a less aesthetical appearance.

The visible exterior surface of the metal sheet may have zero Gaussian curvature. Hence, the curvature line of the metal sheet of the dispenser may in at least one direction zero, i.e. straight, thereby forming a cylindrical curvature or bend with a constant or varying radius of curvature. The visible exterior surface of the metal sheet may also or alternatively have a positive Gaussian curvature, such that the surface of the metal sheet has a positive curvature in all directions.

The metal sheet may be made of a single piece of metal having a substantially constant thickness. This enables an improved aesthetical appearance and simplified metal rolling of the metal sheet.

The metal sheet may have a thickness in the range of 0.2-1.5 millimetres, or in range of 0.35-0.9 millimetres, or in the range of 0.5-0.7 millimetres. The preferred material thickness depends on the material tensile strength and the above-defined ranges apply at least for stainless steel material suitable for being roll formed. A thicker material, such as for example 2 millimetres and above, results in a more expensive and heavy product, and a thinner material, such as for example 0.1 millimetres tend to exhibit insufficient stability to provide the appearance of a solid metal dispenser wall, as well as having low resistance to dents and similar damages.

The metal sheet may be made of stainless steel or an aluminium alloy. Stainless steel is used in particular embodiments, because of its high quality finish and resistance to damages.

The metal sheet may be provided with an anti-fingerprint coating for reduced cleaning needs.

The metal sheet may be non-flat over its entire visible exterior surface. A completely non-flat metal sheet avoids the problem of uneven reflections in the surface of the metal sheet, for example due to a partly flat and partly non-flat exterior surface of the plastic support structure.

The support surface on which the metal sheet is fastened may be non-flat over its entire surface. A non-flat support surface results in a non-flat metal sheet when fastened thereto.

The metal sheet may be supported over substantially its entire interior surface by the support structure. This enables use of thinner metal sheet material since the metal sheet is well supported. A less supported metal sheet requires a higher internal rigidity, i.e. generally a thicker metal sheet, to provide the desired smooth and even curvature.

The dispenser may include at least two outer thin metal sheets, each being fastened to an individual exterior surface of the support structure, and each metal sheet including at least one curvature. This design may be suitable when segments or regions of the dispenser lacks a metal sheet laminated to the support structure, for example openings for dispensing hygienic material or windows for enabling a person to detect present fill level of the hygienic product.

The metal sheet may include folded side edges extending in a direction perpendicular to the direction having a zero curvature. Folded side edges have the advantage of making the metal sheet more user-friendly and safe, as well as improving the visual appearance. The folded, and consequently rounded side edges eliminates the potentially sharp metal side edges that otherwise would be located at the edges of the metal sheet, thereby avoiding any risk of injuries to the user that comes into contact with the dispenser. The folded and rounded side edges also make the position of the side edge with respect to the surrounding wall surface less critical because the surface reflection in the area of the side edge is continuous, i.e. lacks any discrete steps. As a result, a slight deviation from the correct position of the folded side edge has an increased likelihood of being deemed acceptable in terms of assembly quality.

The folded side edges may be folded about 180 degrees inwardly towards the interior of the dispenser. Thereby a double-layered reinforced side edge is provided.

The folded portion of the metal sheets may extend in the range of 1-10 millimetres in a direction perpendicular to the direction having a zero curvature, or in the range of 1-5 millimetres. The folded portion corresponds to the region of the metal sheet having double layers. There is no purpose in having an unnecessary wide folded portion, and, in particular embodiments, the extension is minimized, limited by at least the manufacturing process used for performing the folded portion.

The exterior surface of the metal sheet may be flush with any surrounding exterior surface of the plastic wall of the dispenser. A flush exterior surface provides the appearance of a solid dispenser made of a single piece of material.

The metal sheet may be permanently fastened to the support structure by means of adhesive, in particular by means of double-sided bonding tape or glue. Permanent adhesive fastening enables a quick and strong bonding over a large bonding area and eliminates the need for any protruding fastening elements, such as screws or rivets, such that a smooth outer surface is realised.

The dispenser may include at least one hinge arrangement having first hinge member formed integrally with an interior of the cover, and a second hinge member formed integrally with an interior of a body of the dispenser, such that the at least one hinge arrangement is concealed in a closed state of the dispenser. A further significant improvement of laminating a metal sheet to a plastic support structure is enablement of manufacturing hinge arrangements of plastic material. A plastic hinge arrangement can easily be formed integrally with the plastic interior of the cover and body and avoids the complexity of fastening a separate metal hinge arrangement to a cover and body.

The hinge arrangement may include a vertical pivoting axis enabling the cover to be pivoted sideways during opening and closing of the dispenser. Sideways opening of the dispenser simplifies refill of the dispenser because also shorter persons will have good access to the locking mechanism, which generally is located opposite the hinge arrangement. Moreover, sideways pivoting of the cover means that the cover is less disturbing during refill than refill of dispenser having the cover pivoting downwards towards the user.

Each of the rear wall, the side walls, the front wall and the upper wall may be made at least partly of plastic material. The walls without a metal sheet laminated thereto may be made entirely or substantially entirely of plastic material. These walls may incorporate members of other material, such as metal, for example as reinforcement members, brackets, fasteners, hinge arrangements, locking arrangements, sensor arrangements, etc. Without such members of other material said walls may be made entirely of plastic material. The walls of the dispenser that includes a plastic support structure with a metal sheet laminated thereto may also, when disregarding the laminated metal sheet, be made entirely or substantially entirely of plastic material. The support structure of these walls may incorporate members of other material, such as metal, for example as reinforcement members, brackets, fasteners, hinge arrangements, locking arrangements, sensor arrangements, etc. Without such members of other material said support structure may be made entirely of plastic material.

Hence, the complete dispenser chassis forming the support structure and any wall lacking a laminated metal sheet can be made entirely or substantially entirely of plastic material, such that a plastic dispenser chassis is provided. The metal sheet is subsequently laminated on selected surface regions of selected side walls of the plastic chassis for providing the desired metal finish of the dispenser.

The cover may form at least part of the front wall and at least part of the upper wall of the dispenser, and the cover may extend over the entire width of the dispenser. Refill of the dispenser may be simplified by providing a relatively large cover. However, sideways pivoting of a rectangular-shaped cover in combination with the desire to provide a flush mounting of the metal sheet with the surrounding plastic wall generally prevents the cover from extending over only part of the width of the dispenser because the cover may otherwise collide with the body during pivoting motion of the cover. A collision can be avoided by designing the cover to extend over the entire width of the dispenser.

The dispenser may be arranged to be permanently mounted with its rear wall to a vertical wall of a room, or as stand-alone dispenser suitable for being positioned on a horizontal surface.

The dispenser may be arranged to dispense tissue sheets from a stack of sheets or a roll, or liquid or viscous materials, in particular liquid soap.

BRIEF DESCRIPTION OF THE DRAWINGS

Embodiments of the invention will now be described in detail with reference to the figures, wherein.

DETAILED DESCRIPTION OF PARTICULAR EMBODIMENTS

Various aspects of the invention will hereinafter be described in conjunction with the appended drawings to illustrate and not to limit the invention, wherein like designations denote like elements, and variations of the inventive aspects are not restricted to the specifically shown embodiments, but are applicable on other variations of the invention.

Figure 1:
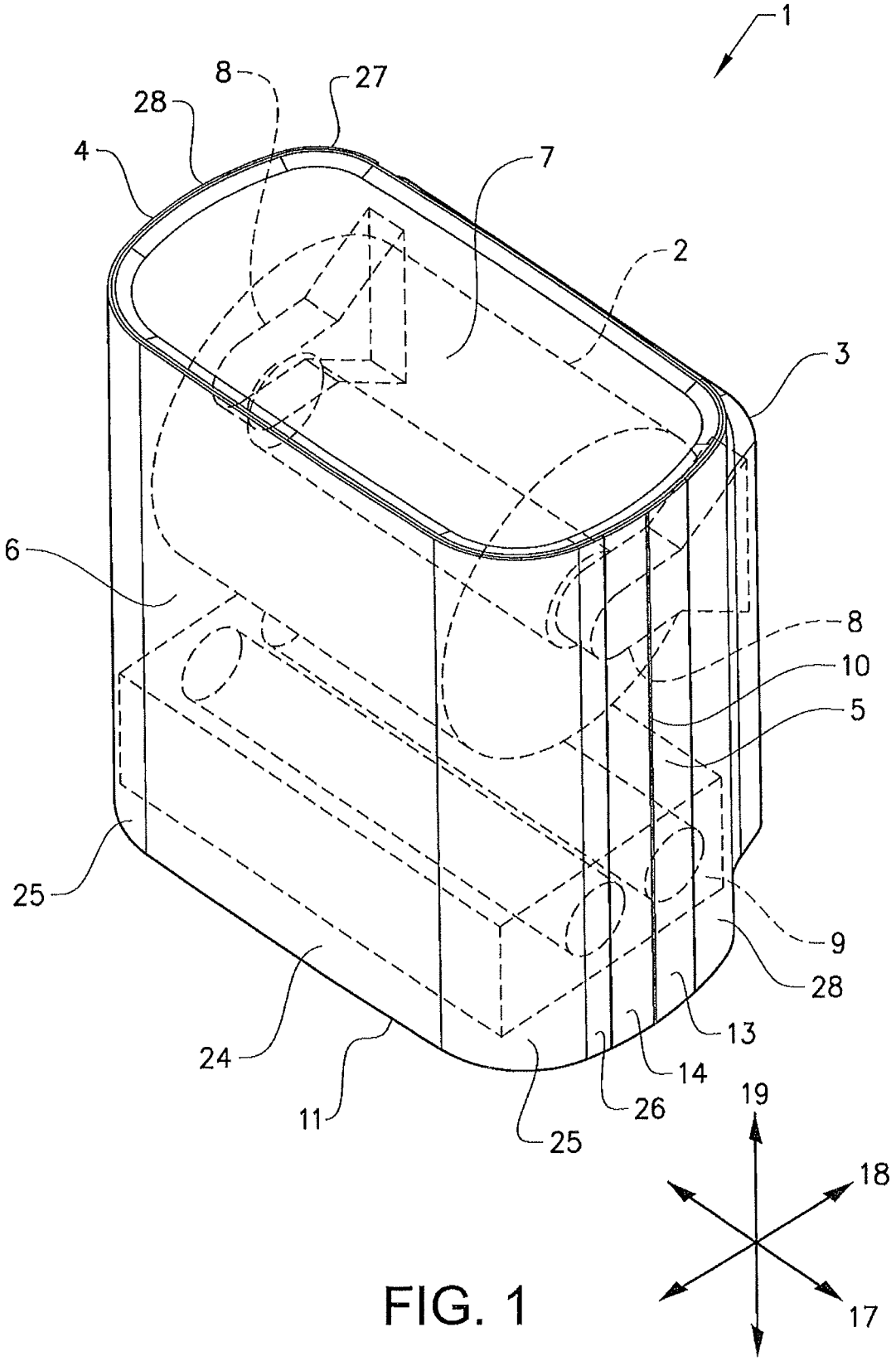
FIG. 1 shows a perspective view of a dispenser according to an embodiment of the invention.

FIG. 1 shows a dispenser 1 for dispensing sheet material from a sheet roll 2 stored within the dispenser 1. The dispenser 1 has a generally rectangular shape and includes in a closed state a rear wall 3, two opposite side walls 4, 5, a front wall 6 and an upper wall 7. This type of dispenser is generally arranged to be fastened with its rear flat wall 3 attached to a vertical wall of a room, such as a sanitary room, by means of fasteners, adhesive or other suitable fastening means. The roll 2 is here replaceable and rotationally secured within the dispenser 1 by means of roll holders 8. A feeding cassette 9 including a motor driven roller or similar feeding mechanism is also provided within the dispenser 1 for automatically feeding a piece of sheet material from the roll 2 upon detecting the presence of a user in the vicinity of a proximity sensor (non-showed). The fed piece of sheet material exits the dispenser 1 via a dispensing opening 11 located at the lower side of the dispenser 1. The dispenser 1 is openable for refill when the roll 2 is depleted. The chassis of the dispenser is made in two parts, a body 13 and a cover 14, for enabling opening of the dispenser 1. A user may open the dispenser by pivoting the cover 14 to an open state. The cover 14 includes here the front wall and parts of the side walls 4, 5, and a split line 10 is provided vertically on the side walls 4, 5. The cover 14 may be openable by means of two vertically spaced apart hinge arrangements, each having a first plastic hinge member formed integrally with an interior of the cover 14, and a second plastic hinge member formed integrally with an interior of the body 13. The hinge arrangement may include a vertically arranged pivoting axis enabling the cover 14 to be pivoted sideways during opening and closing of the dispenser, and a locking device located on an opposite side of the cover 14 for enabling locking of the cover 14 in a closed state. The hinge arrangement is not shown in the figures but a similar hinge arrangement is disclosed in detail in WO 2011/0023611, which is referred to in its entirety.

Figure 2:
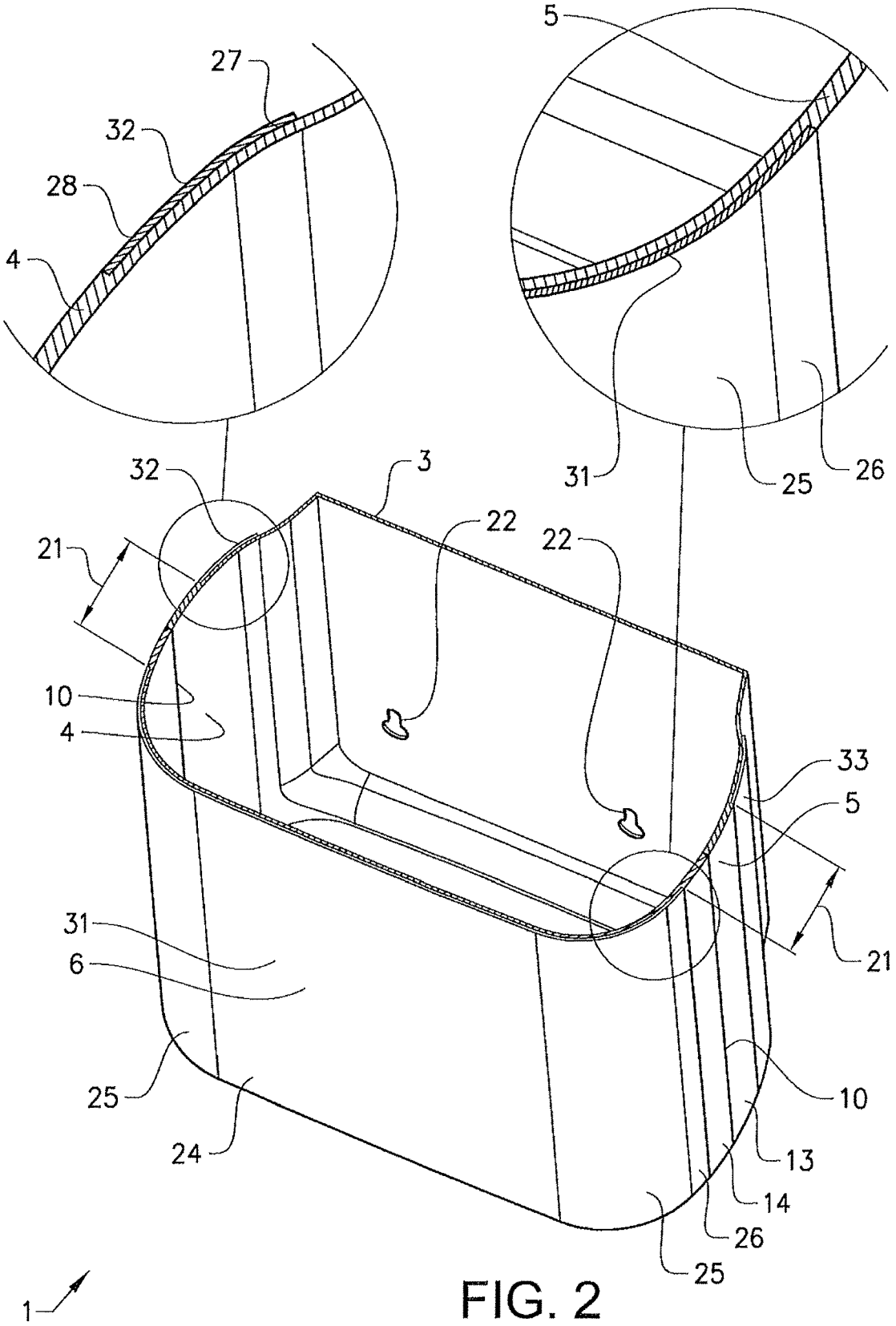
FIG. 2 shows a cross-sectional view of the dispenser of FIG. 1.
Figure 3:
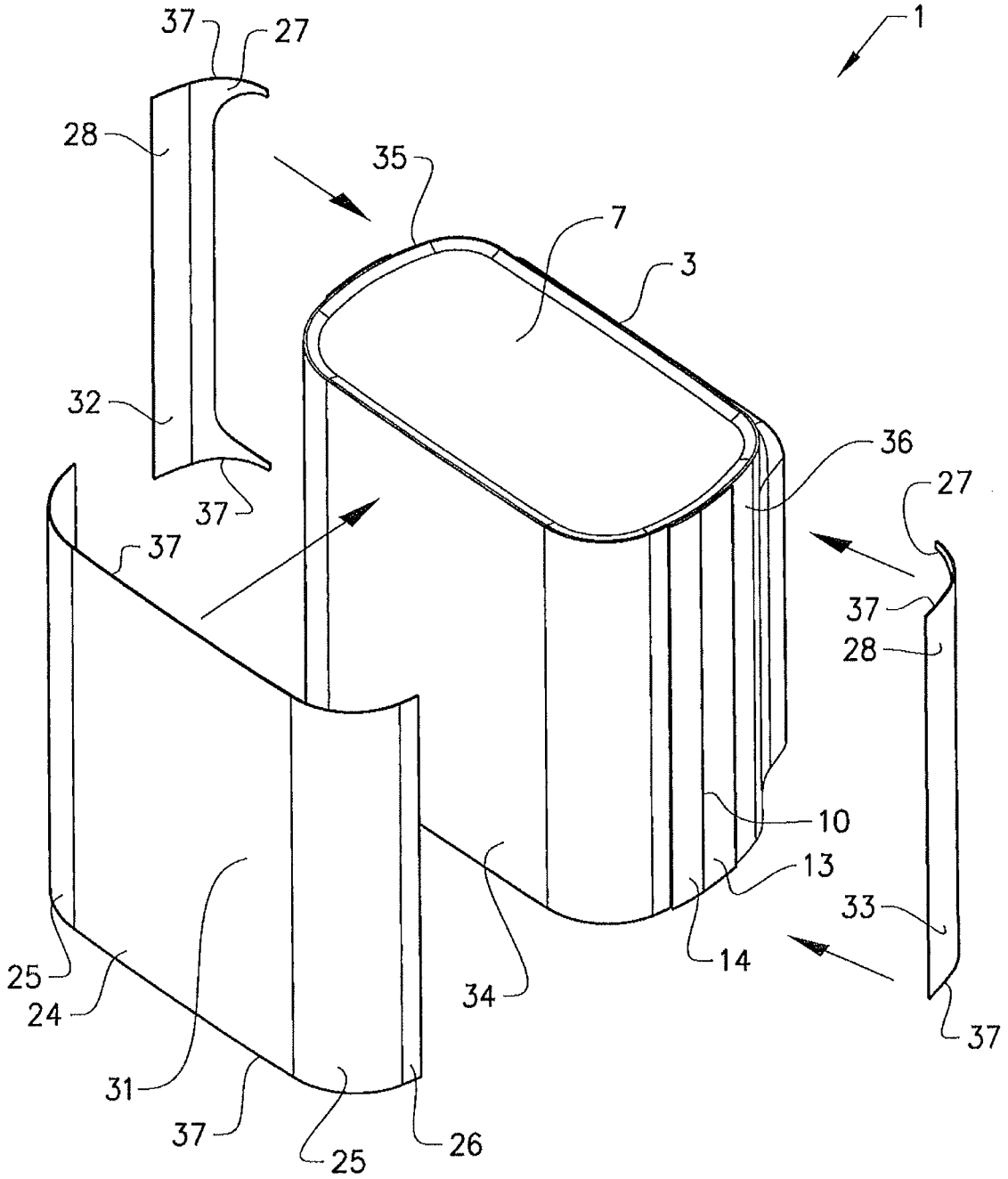
FIG. 3 shows an exploded view of the dispenser of FIG. 1.

FIG. 2 shows a horizontal cross-sectional cut through the body 13 and cover 14 of the dispenser of FIG. 1 but without the previously described inner content, and FIG. 3 shows the dispenser of FIG. 1 in a partly exploded view. The dispenser 1 is made primarily of plastic material, for example by an injection moulding process. The body 13 may be made as a first single piece and the cover 14 as a second single piece. The side walls 4, 5 and the front wall 6 are made of composite plastic and metal material where a plastic support structure 34-36 carries a thin metal sheet 31-33. The rear wall 3 and the upper wall 7 are made of plastic material only. Mounting holes 22 are provided in the rear wall 3 for receiving fasteners or the like. An exterior surface of a front support structure 34 includes an outer thin metal sheet 31 laminated thereto, and each of the side support structures 35, 36 includes an outer thin metal sheet 32, 33 laminated thereto respectively. The metal sheet 31 at the front extends over the entire height of the dispenser, i.e. from the upper wall 7 to the lower edge of the front wall 6 in a vertical direction 19. The metal sheet 31 at the front further extends over the entire front wall 6 of the dispenser in a side direction 17 and continues a certain length onto respective side walls 4, 5. Each metal sheet 32, 33 at the side covers part of the remaining surface of the side wall 4, 5, leaving an intermediate vertically oriented strip-shaped region 21 lacking a metal sheet. The metal sheet 31 at the front includes a centrally arranged region 24 having a relatively large radius of curvature and lateral front corner regions 25 located on both side of the central region 24, which corner regions 25 have smaller radius of curvature. The metal sheet 31 at the front further comprises a region 26 with a larger radius of curvature again extending a certain distance onto the side wall 4, 5. The metal sheets 32, 33 at the sides have a relatively large curvature in the regions 28 of the side walls 4, 5 of the dispenser and a smaller radius of curvature in the rear corner regions 27.

The plastic side walls of the dispenser serve as support structures 34-36 for the metal sheets 31-33. Since the underlying support structure 34-36 of each metal sheet 31-33 provides the necessary strength and rigidity of the dispenser, the metal sheets 31-33 can be made relatively thin without having problems with stability or deformation. The metal sheets 31-33 provide the dispenser 1 with a perceived robust design and an aesthetical appearance while still enabling a low manufacturing cost. The metal sheets of the dispenser makes the user perceive the dispenser as being made more or less completely of metal, and consequently as a relatively robust and high quality dispenser. A dispenser made more or less completely of metal has many disadvantages, such as problems of assembling metal parts by welding, which often results in low surface finish of the dispenser, and being technically difficult for stainless steel. A metal dispenser is also relatively heavy and costly due to the material cost and is difficult to manufacture. Consequently, the disclosed dispenser combines the advantages of a plastic dispenser, such as cost-effective manufacturing and low weight, with the advantages of a metal outer finish, such as resistance to scratches or long-term use, attractive appearance and high exterior surface finish. The combination of a plastic supporting chassis of the dispenser with the exteriorly mounted thin metal sheet is realised by a cost-effective lamination process where the plastic chassis and metal sheet first are manufactured individually before being joined in a lamination process. Thereby, both the plastic dispenser chassis and metal sheet can be manufactured using manufacturing processes selected specifically for each part. The final lamination process of the pre-formed plastic dispenser and pre-formed metal sheet may subsequently be easily and quickly performed.

Each metal sheet 31-33 can be permanently fastened to the support structure of the dispenser by means adhesive, in particular by means of double-sided bonding tape or glue. Attachment by adhesive has the advantage of enabling attachment over a large surface area and without any visible fasteners, such as screw or rivets. Each metal sheet 31-33 is here supported over substantially its entire interior surface by an individual support structure 34-36. Thereby, a reduced metal sheet thickness can be selected, and the form of the assembled dispenser is largely determined by the form of the exterior surfaces of the support structure 34-36. However, the support structure 34-36 can alternatively include holes and cavities within the support structure 34-36, and merely form a framework of exterior surfaces on which the metal sheets 31-33 are laminated. This design requires less plastic material but also metal sheets 31-33 that exhibit a certain minimum internal strength and rigidity to prevent deformation of the metal sheets 31-33 in the areas lacking support from the support structure 34-36.

The metal sheet can be made of stainless steel due to its corrosion and stain resistance, as well as the low maintenance and lustre. However, other metal material may alternatively be used, such as aluminium alloy or more conventional steel. If stainless steel is selected it may be advantageous to apply an anti-fingerprint coating to the metal sheet, or selecting a stainless steel grade having a fingerprint-resistant surface finish. Each individual metal sheet laminated to the support structure is made of single piece of metal having a substantially constant material thickness. The metal sheet has typically a thickness in the range of 0.2-1.5 millimetres, or in the range of 0.35-0.9 millimetres, or in the range of 0.5-0.7 millimetres. The preferred thickness depends on the tensile strength of the selected material, as well as on the design of the underlying support structure, and may be selected in accordance with the specific need.

The dispenser is designed to have a smooth exterior surface. This aspect is for example illustrated in FIG. 2, where the plastic side wall 4 exhibits an increased wall thickness in a region 21 lacking a metal sheet. On both sides of said region 21 the plastic wall thickness is smaller. The plastic wall thickness is selected such that the combined thickness of the smaller plastic wall thickness and the thickness of the metal layer is identical to the plastic wall thickness of said region 21. As a result the plastic side wall and the metal sheet jointly form a continuous flush outer surface of the dispenser.

The dispenser shown in FIGS. 1-3 includes three outer thin metal sheets 31-33, each being fastened to an individual exterior surface of the support structure 34-36. The selection of number of metal sheets is largely a matter of design, but limitations in the selected manufacturing process also sets a limit to the extent a single metal sheet can be used. For example, the dispenser of FIG. 1-3 includes a region 21 in each side wall 4, 5 lacking a metal sheet. This region 21 may be provided with a transparent or semi-transparent plastic material for enabling maintenance personnel to easily check current fill level of the dispenser, without opening the dispenser. Furthermore, the manufacturing method used also influences the number and shape of the metal sheets. A roll forming process may produce metal sheets having 360 degrees coverage of the dispenser, i.e. a single metal sheet that completely encircles and envelopes the plastic dispenser. A roll forming process has however limitations in terms of the curvature in the direction of the rollers and is optimally used for manufacturing a metal sheet having a curvature in a first direction and with zero curvature in the perpendicular direction, i.e. a cylindrical curvature. The radius of the cylindrical curvature can be fixed for certain segments and continuously varying for certain segments. An alternative manufacturing process is press forming of the metal sheet. Press forming is performed by pressing a flat metal sheet by a press tool that includes a press surface having a desired form. After pressing the metal sheet is formed by the press tool and may exhibit a complex three-dimensional shape. There is however limitations in terms of coverage of such a metal sheet, which typically cannot cover much more than a single side wall. The metal sheets 31-33 in the dispenser of FIGS. 1-3 can for example be formed by both roll forming and press forming. The metal sheets 31-33 can extend in the vertical direction 19 from the bottom to the top of the dispenser 1, thereby covering nearly the entire visible surface of the dispenser in a closed and mounted state. The metal sheets 31-33 can exhibit a cylindrical curvature over the complete outer surface, wherein the radius of curvature may be fixed in certain segments and continuously varying in certain segments, thereby eliminating any flat metal surfaces. The folded side edge 37 of the metal sheets 31-33 may be folded to provide a smoother and more attractive edge of the metal sheet 31-33, as will be described more in detail below.

Figure 4:
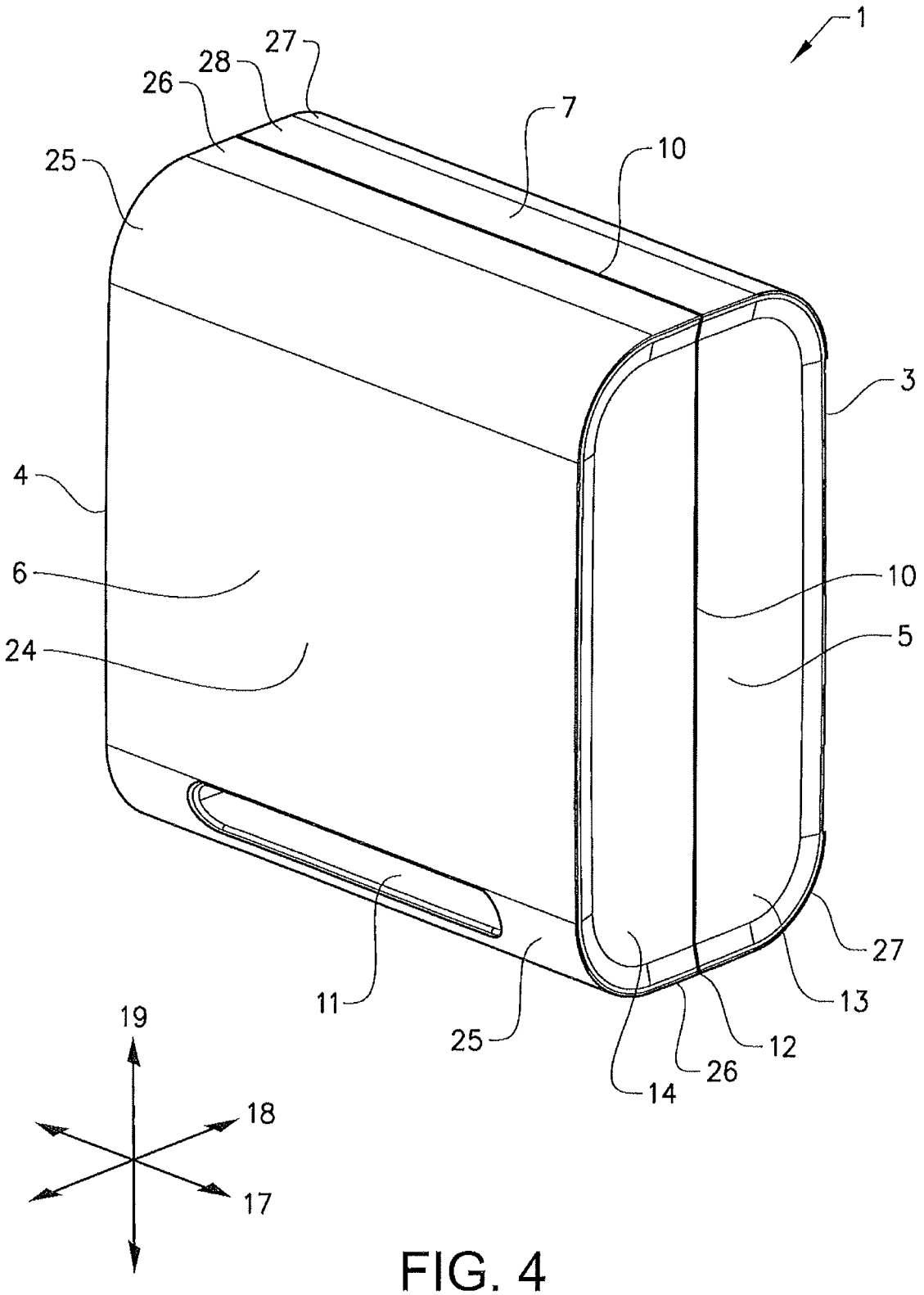
FIG. 4 shows a perspective view of an alternative dispenser according to another embodiment of the invention.

The dispenser shown in FIG. 4 has a similar design as the dispenser of FIGS. 1-3, but with the main difference that the metal sheet here encircles the front, upper and lower walls 6, 7, 12 of the dispenser 1 instead of the front and side walls 4-6. The inner content of the dispenser 1 is not shown, but may correspond to the inner content of the previously described dispenser, i.e. a roll and a feeding cassette. Also this dispenser design includes a body 13 and a cover 14 that is pivotally mounted to the body 13. A split line 10 between the body 13 and cover 14 is located in a vertical plane. A minor difference is also the location and form of the dispensing opening, which here is located at the lower region of the front wall 6. The entire side walls 4, 5 may here be formed of transparent or semi-transparent plastic material for enabling maintenance personnel to easily check current fill level of the dispenser.

An exterior surface of the front support structure 34 of the dispenser 1 includes an outer thin metal sheet 31 laminated thereto, an exterior surface of an upper support structure 38 of the dispenser 1 includes an outer thin metal sheet 32, and an exterior surface of a lower support structure 39 of the dispenser 1 includes an outer thin metal sheet 33 laminated thereto respectively. The metal sheet 31 at the front extends over the entire width of the dispenser, i.e. from one side wall 4 to the other side wall 5. The metal sheet 31 at the front further extends over the entire front wall 6 of the dispenser in the vertical direction 19 and continues a certain length onto the upper and lower support structures 38, 39 respectively. The metal sheet 32 at the upper wall 7 covers the remaining part of the upper support structure 38 and extends a certain distance down towards or on the rear wall 3. Similarly, the metal sheet 33 of the lower support structure 39 covers the remaining part of the lower support structure 39 and extends a certain distance up towards or on the rear wall 3. The metal sheet 31 at the front includes a centrally arranged front region 24 having a relatively large radius of curvature, front corner regions 25 having a reduced radius of curvature and side regions 26 with a larger radius of curvature again. The metal sheets 32, 33 at the upper and lower walls have in the region 28 of the upper and lower walls 7, 12 a relatively large radius of curvature and in the rear corner regions 27 a smaller radius of curvature.

The visible exterior surface of at least one metal sheet 31-33 exhibits in a closed state of the dispenser 1 a curved surface in at least one direction, or over the entire outer surface of the metal sheet 31-33. This aspect concerns primarily the metal sheets of the dispenser that are easily observable on a closed dispenser by a user. One reason for providing the metal sheet with a curved surface is to accomplish a more attractive visual appearance. Plastic material is difficult to control during the solidification phase and a flat surface may exhibit regions of flat surfaces and regions of non-flat surfaces. A thin metal sheet laminated on such a plastic support surface would exhibit regions of flat surfaces and regions of non-flat surfaces, such the reflections seen by a user would include discrete steps, non-continuous variations, etc. thereby generating a non-esthetical visual impression. One way for avoiding this unambiguous surface condition is to provide a part of the support structure in at least critical areas with a pre-curved surface, thereby creating a controlled continuous change in reflection as seen by a user. Critical areas are those areas that are most often view by a user. Also, the metal sheet laminated to the front wall of the dispenser can be a curved surface. For example, the visible exterior surface of the metal sheet in the front region 24, side region, upper region or lower region 26 wall may have a radius of curvature in the range of 500-15 000 millimetres, or in the range of 1000-12 000 millimetres, or in the range of 4000-8000 millimetres. The exterior surface of the metal sheet in the corner regions between neighbouring wall sections may have a radius of curvature in the range of 5-200 millimetres, or in the range of 10-130 millimetres, or in the range of 30-80 millimetres.

The visible exterior surface of the metal sheet can be free from discrete changes in radius of curvature for the purpose of avoiding any interruptions and/or un-continuous reflections in the surface of the metal sheets. As a matter of fact, the metal sheet can be non-flat over its entire visible exterior surface, and also the support surface on which the metal sheet is fastened can be non-flat over its entire support surface.

The visible exterior surface of the metal sheet may have a certain radius of curvature in a first direction and zero radius of curvature in a second direction, which is different from the first direction, which arrangement is referred to as a surface having zero Gaussian curvature. A curved metal sheet surface having zero Gaussian curvature at a point P means that the metal sheet surface has at point P zero radius of curvature in at least one direction, i.e. no curvature in at least one direction. Furthermore, the visible exterior surface of the metal sheet may have a curvature in each position of the visible exterior surface of the metal sheet while still having zero Gaussian curvature in all said positions. This corresponds to a metal sheet having a cylindrical curvature or bend with partly fixed and/or partly varying radius of curvature over the complete length of the metal sheet, and with zero curvature in the direction perpendicular to a length direction. Such a curved metal sheet is advantageously formed in a roll forming process since a computer numerical controlled (CNC) cylindrical press rollers of the roll forming machine enable cost-efficient and flexible forming of metal sheets having nearly no limitation in terms of the radius of curvature of the rolled surfaces.

Alternatively, the surface of the metal sheet includes a positive Gaussian curvature at least one surface point, or at each exterior surface point of the metal sheet surface. Such a metal sheet can be manufactured by pressing the metal sheet in a hydraulic press using a special pressing tool. The Gaussian curvature at any point of a surface may be defined as the product of two principal curvatures $K=k1\times k2$, where a first principal curvature k1 corresponds to the maximal curvature at said point and the second principal curvature k2 corresponds to the minimum curvature at said point. A cylindrical surface consequently has zero Gaussian curvature because the curvature along the length of the cylinder is zero and in other directions there is positive curvature so the product of the maximum and minimum curvatures k1, k2 is zero making the Gaussian curvature zero. A surface having a point where both principal curvatures are positive is referred to as a positive Gaussian curvature, i.e. a point on the surface where the surface is convex in all directions.

Figure 5:
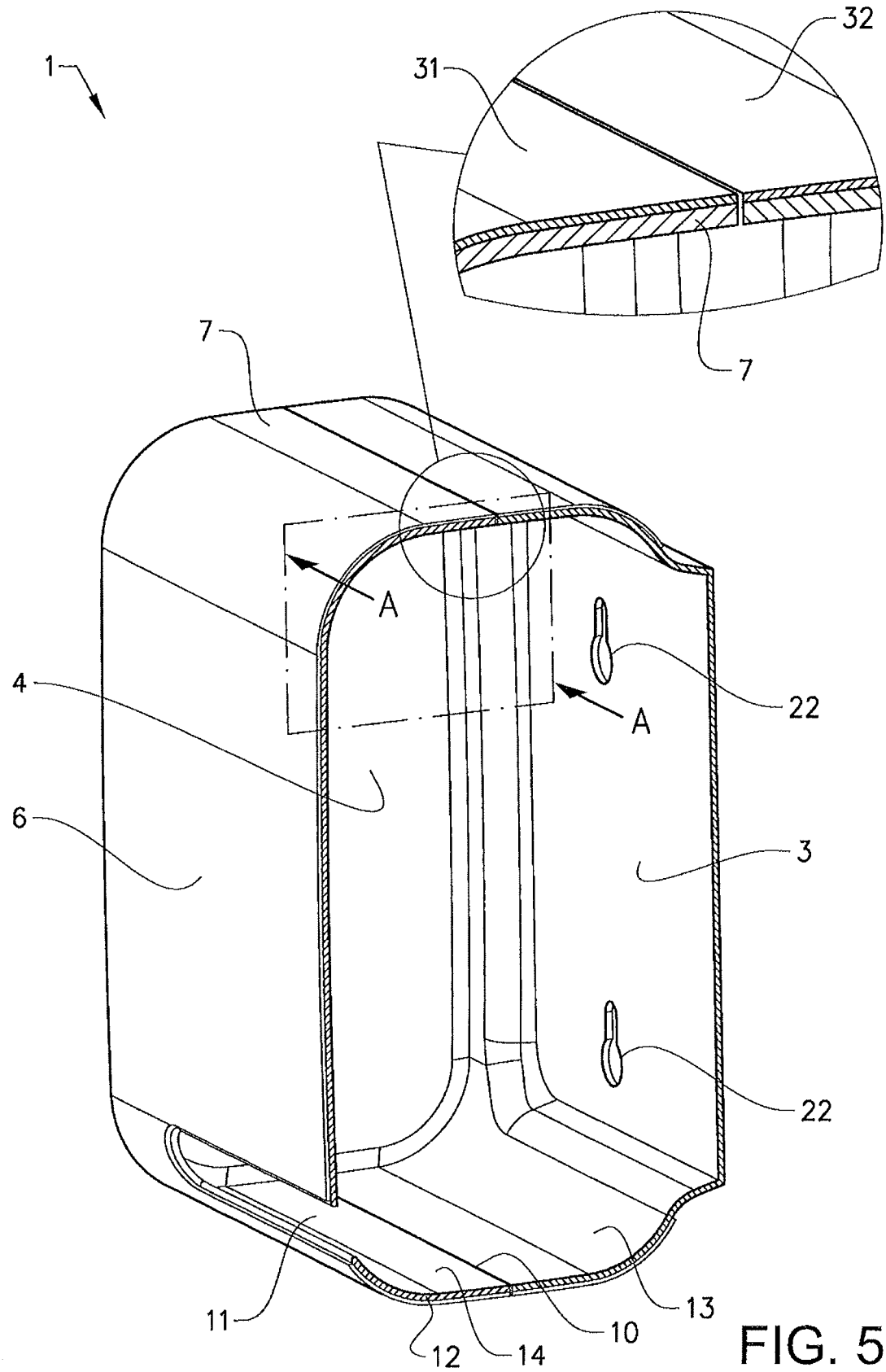
FIG. 5 shows a cross-sectional view of the dispenser of FIG. 4.
Figure 6:
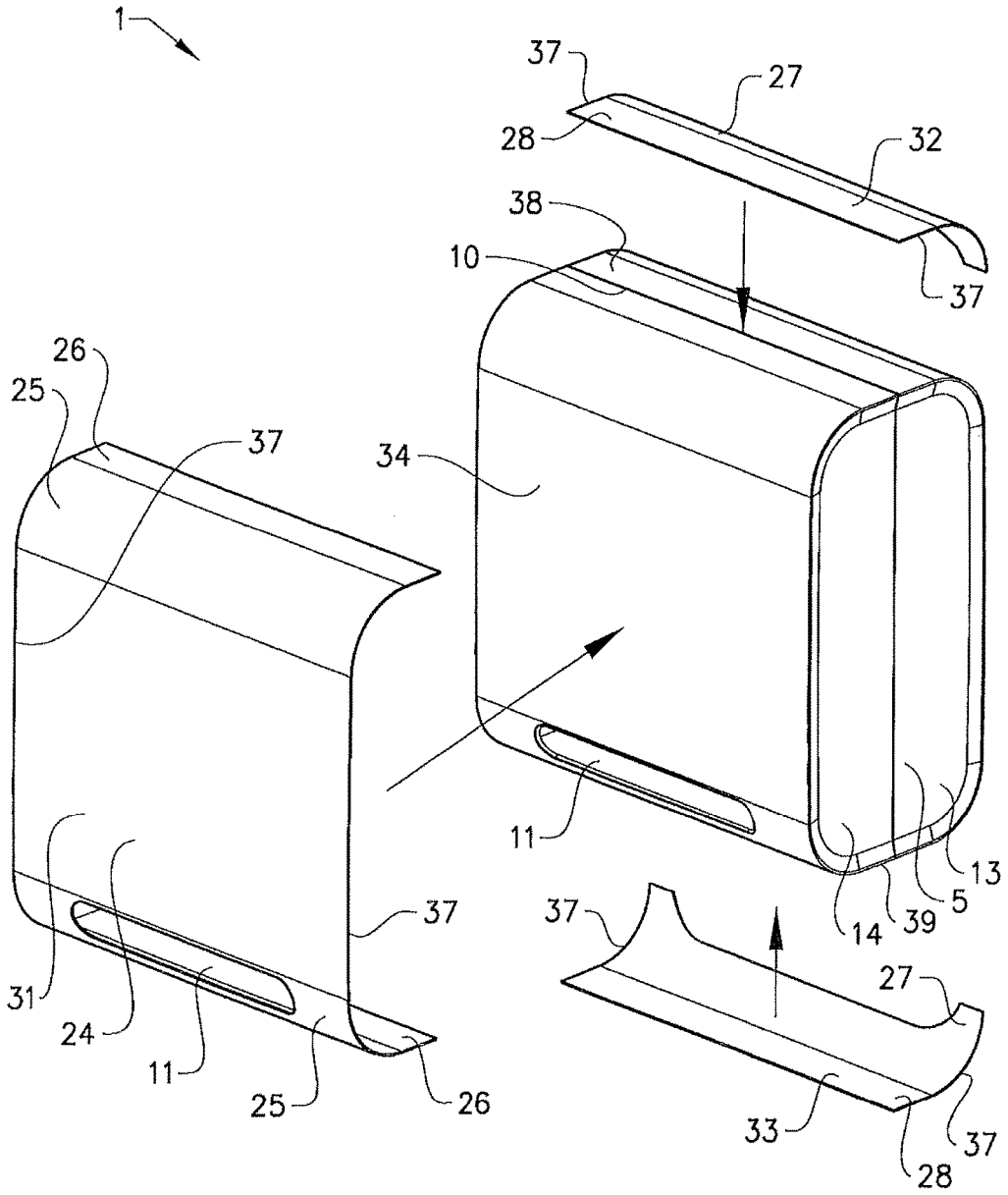
FIG. 6 shows an exploded view of the dispenser of FIG. 4.
Figure 7:
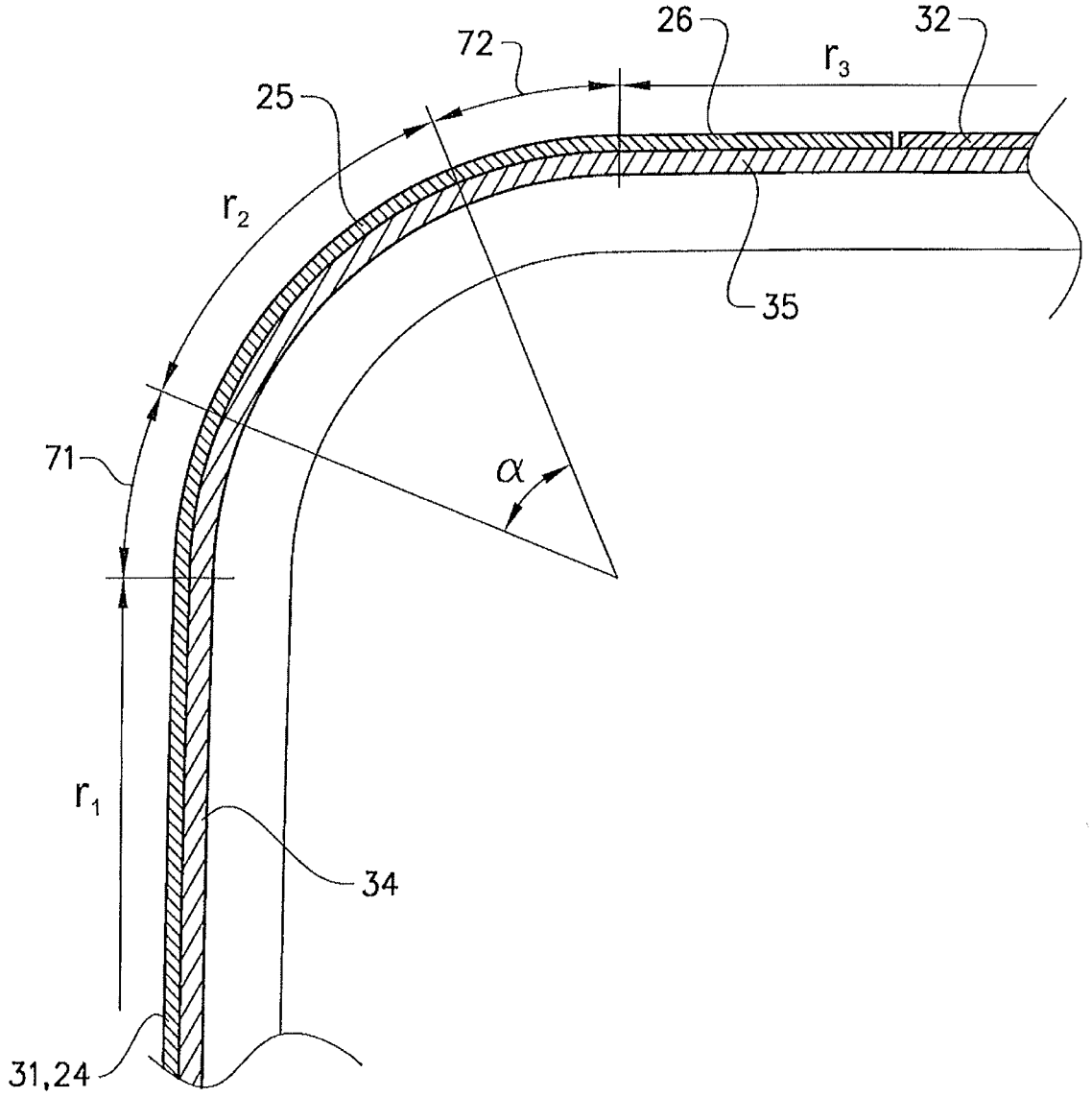
FIG. 7 shows a cross-sectional view of the dispenser of FIG. 4.

FIG. 7 shows a cross-sectional cut A-A in a side direction 17 in the front upper corner of the dispenser of FIG. 5 and illustrates an exemplary solution for avoiding discrete steps in radius of curvature of the metal sheet. The metal sheet 31 at the front is provided with a first constant radius of curvature $r_1$ over at least an upper section of the centrally arranged region 24. The front corner regions 25 of the metal sheet 31 at the front is provided with a second constant radius of curvature $r_2$ over a certain angle $\alpha$, and an upper region 26 of the metal sheet 31 at the front is provided with a third constant radius of curvature $r_3$. For preventing the first radius of curvature $r_1$ suddenly changing to the second radius of curvature $r_2$, a first lead in section 71 is provided between the first radius of curvature $r_1$ and second radius of curvature $r_2$. In this first lead in section 71 the radius of curvature is arranged to continuously change from the first radius of curvature $r_1$ to second radius of curvature $r_2$ for the purpose of providing a smooth transition between differently curved surfaces, and such that surface reflections observed by a user are continuous and without discrete steps. A similar second lead in section 72 is provided between the second radius of curvature $r_2$ and third radius of curvature $r_3$. According to a specific non-limiting example, for the propose of illustrating an example relationship between a radius of curvature and dispenser dimension, a dispenser having a rectangular shape with a width x height x depth of about 300×450×100 millimetres and being suitable for dispensing individual hand towels from a stack of towels may for example have a first constant cylindrical radius of curvature $r_1$ of about 6000 millimetres, a second constant cylindrical radius of curvature $r_2$ of about 50 millimetres and a third constant cylindrical radius of curvature $r_3$ of about 150 millimetres.

The disclosed dispenser may be arranged to dispense different types of hygienic material without departing from the inventive concept, and where only small modifications in shape, form, and size of the dispenser is required to suit the new dispensing material. For example, the disclosed dispenser may be arranged to dispense handtowels, napkins, toilette paper, wiping sheets and similar hygienic products. More in detail, the dispenser may dispense individual precut tissue sheets from an interfolded or non-interfolded stack of sheets. The dispenser may be provided with a tear surface close to the dispensing opening for enabling a user to tear of a length of sheet material from a roll within the dispenser, or the dispenser may be provided with cutting means for automatically cutting and dispensing pieces of sheet material from a roll within the dispenser. The sheet material may be paper sheet material, or other types of sheet material having a mixture of cellulosic, synthetic, non-synthetic fibres and nonwoven tissue. The dispenser may alternatively be formed to carry a container with liquid or viscous materials, in particular liquid soap. The position of the dispensing opening is irrelevant to the invention and may for example be located at the bottom or top of the dispenser. Similarly, the dispenser may be suitable for being fastened to a vertical wall or free-standing.

Figure 8:
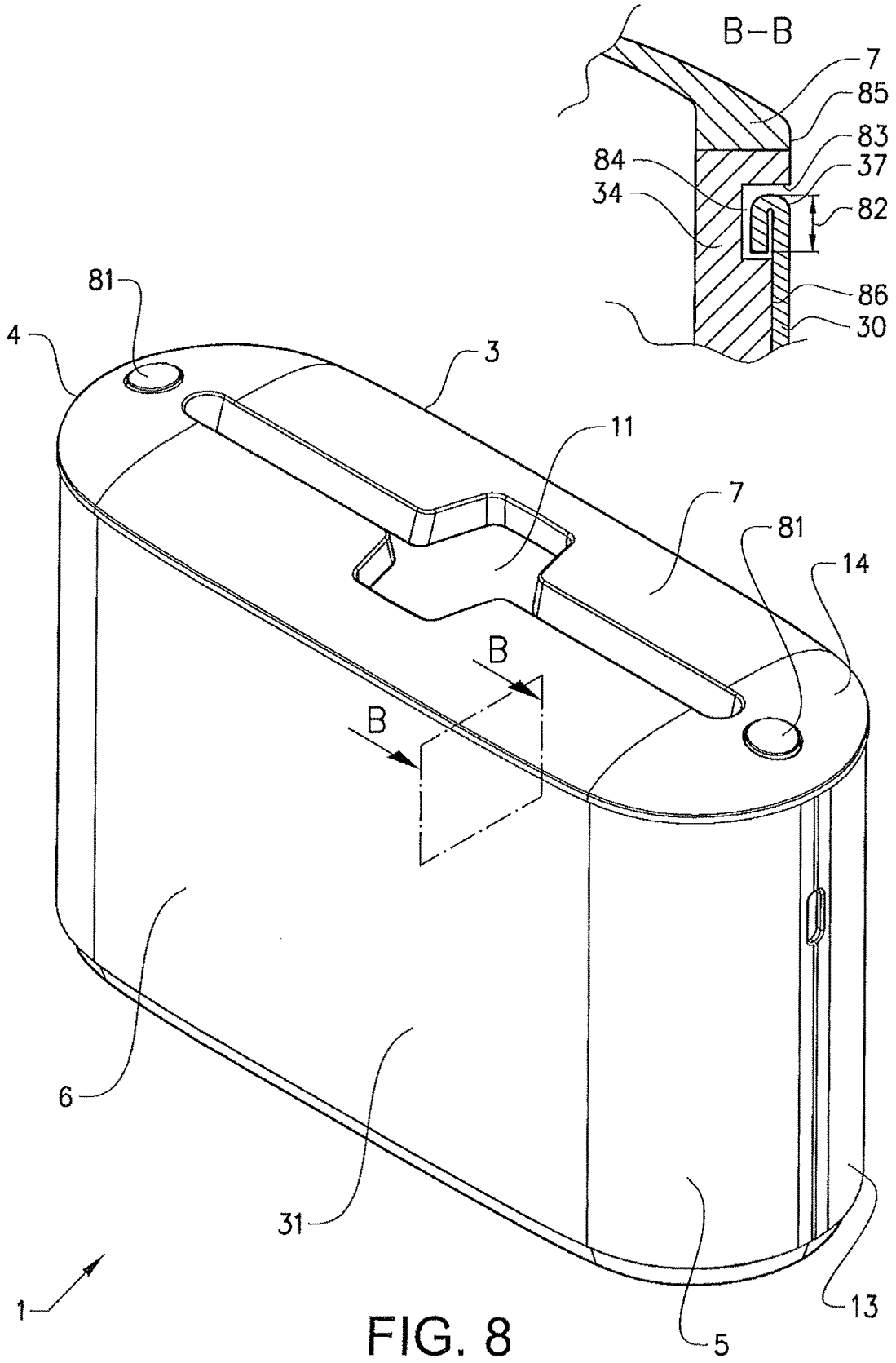
FIG. 8 shows a perspective view of an alternative dispenser according to yet another embodiment of the invention.

A free-standing table dispenser is for example shown in FIG. 8. The dispenser 1 includes a stack of individual sheet material that may be withdrawn by a user through the elongated dispensing opening 11. Refill is realised by pressing actuation members 81 and removing the upper wall 7 from the dispenser body. The plastic body of the dispenser is enveloped in a single metal sheet 30 that stretches along the front wall 6, side walls 4, 5 and rear wall 7 of the dispenser, such that the entire dispenser is surrounded by the metal sheet 30. The metal sheet includes different radiuses of curvature around the circumference of the dispenser but with zero curvature in a height direction of the dispenser.

The cross-sectional cut along section B-B in FIG. 8, where the metal sheet 30 is shown laminated to the underlying support structure 34 shows that the metal sheet can include a folded side edge 37 which extends in a direction of curvature of the metal sheet 30. The folded side edge 37 has been folded about 180 degrees inwardly towards the interior of the dispenser 1 and the folded portion 82 of the metal sheet 30 extends in the range of 1-10 millimetres in a direction perpendicular to the folded side edge, i.e. in the height direction, or in the range of 1-5 millimetres. The folded side edge 37 reduces the risk of injuries on the side edge of the metal sheet 30 and improves the visual appearance. The folded side edge also enables an increased positioning tolerance of the metal sheet 30 with respect to the support structure 34 because the curved surface of the folded side edge 37 does not signalise that the folded side edge 37 is positioned too far away from a counter surface 83 of the support structure 34. The support structure may be provided with a peripheral channel 84 or the like for receiving the relatively thick folded edge 37. The radial extension of the exterior surface 86 of the support structure 34, the radial extension of any neighbouring surface 85 of the metal sheet 30 and the thickness of the metal sheet 30 itself including any adhesive layer (non-showed) can be selected to provide a flush transition from the outer surface of the metal sheet 30 to the outer neighbouring surface 85 of the metal sheet 30. This design with a folded side edge may be equally applied to the metal sheets 31-33 of the dispenser shown in FIGS. 1-6.

The disclosure also involves a method for manufacturing a dispenser according to an embodiment of the invention. The method includes the step of forming a dispenser 1 made mainly of plastic material. The dispenser including, in a closed state a rear wall 3, two opposite side walls 4, 5, a front wall 6, an upper wall 7, a dispensing opening 11 and an openable cover 14 that may be opened for refill of the dispenser 1, wherein at least one wall of the dispenser 1 includes a support structure 34-36, 38, 39 made at least mainly of plastic material. The method further includes the step of preparing the metal sheet 31-33. This is performed by cutting and mechanically forming the metal sheet 31-33, such that metal sheet 31-33 includes a curved surface in at least one direction. A final step of the method includes laminating the metal sheet 31-33 onto an exterior surface of the support structure 34-36, 38, 39, for example by means of an adhesive, such as a double-sided adhesive tape.

Reference signs mentioned in the claims should not be seen as limiting the extent of the matter protected by the claims, and their sole function is to make claims easier to understand.

As will be realised, the invention is capable of modification in various obvious respects, all without departing from the scope of the appended claims. For example, the radius of curvature of the metal sheets 31-33 may be constant of certain segments and vary more or less continuously over other segments. The metal sheets 31-33 may exhibit zero curvature in a first direction and a positive curvature in a second direction perpendicular to the first direction, either in certain areas or over the entire surface of the metal sheet. The metal sheets 31-33 may alternatively, or in combination with the above, include regions having a positive curvature in both said first and second direction. Furthermore, the dispenser according to an embodiment of the invention may alternatively have a cylindrical or elliptical outer form. Accordingly, the drawings and the description thereto are to be regarded as illustrative in nature, and not restrictive.

The invention claimed is:

1. A dispenser for storing and dispensing hygiene products, comprising, in a closed state:

a rear wall, two opposite side walls, a front wall, an upper wall, a dispensing opening, and an openable cover that may be opened for refill of the dispenser, wherein the walls of the dispenser are made at least mainly of plastic material, wherein an outer thin metal sheet is laminated to a portion, but not all of, an exterior surface of the walls, and wherein a surface of the metal sheet comprises a curved surface having a first radius of curvature in at least one direction and the metal sheet comprises at least one folded side edge forming a double-layered side edge.

2. The dispenser according to claim 1, wherein the metal sheet extends continuously over part of at least two neighbouring walls of the dispenser.

3. The dispenser according to claim 1, wherein the metal sheet extends continuously over part of at least three consecutive walls of the dispenser.

4. The dispenser according to claim 3, wherein the walls are at least the front wall and the two opposite side walls, or the front wall, the upper wall, and a lower wall.

5. The dispenser according to claim 1, wherein the surface of the metal sheet in a centre region of the walls has a radius of curvature in the range of 500-15,000 millimetres.

6. The dispenser according to claim 1, wherein the exterior surface of the metal sheet, in the corner region between neighbouring wall sections, has a radius of curvature in the range of 5-200 millimetres.

7. The dispenser according to claim 1, wherein the exterior surface of the metal sheet is free from discrete changes in radius of curvature.

8. The dispenser according to claim 1, wherein the exterior surface of the metal sheet has zero Gaussian curvature or a positive Gaussian curvature.

9. The dispenser according to claim 1, wherein the metal sheet exhibits a cylindrical curvature over at least a main region of the surface of the metal sheet.

10. The dispenser according to claim 1, wherein the metal sheet is a single piece of metal having a substantially constant thickness.

11. The dispenser according to claim 1, wherein the metal sheet has a thickness in the range of 0.2-1.5 millimetres.

12. The dispenser according to claim 1, wherein the metal sheet is made of stainless steel or an aluminium alloy.

13. The dispenser according to claim 12, wherein the metal sheet is provided with an anti-fingerprint coating.

14. The dispenser according to claim 1, wherein all of an exterior surface of the metal sheet is non-flat.

15. The dispenser according to claim 1, wherein all of a portion of the exterior surface on which the metal sheet is fastened is non-flat.

16. The dispenser according to claim 1, wherein substantially all of an interior surface of the metal sheet is supported by at least one of the walls.

17. The dispenser according to claim 1, wherein the dispenser comprises at least two outer thin metal sheets, each being fastened to an individual exterior surface of at least one of the walls, and each metal sheet comprising a curved surface in at least one direction.

18. The dispenser according to claim 1, wherein the at least one folded side edge extends in a direction of curvature of the metal sheet.

19. The dispenser according to claim 1, wherein the at least one folded side edge has been folded about 180 degrees inwardly towards the interior of the dispenser such that the at least one folded side edge is laminated within a peripheral channel of the support surface for receiving the at least one folded side edge.

20. The dispenser according to claim 18, wherein the folded portion of the metal sheet extends in the range of 1-10 millimetres in a direction perpendicular to the folded side edge.

21. The dispenser according to claim 1, wherein the exterior surface of the metal sheet is flush with any neighbouring exterior surface of the plastic wall of the dispenser.

22. The dispenser according to claim 1, wherein the metal sheet is permanently fastened to at least one of the walls by adhesive.

23. The dispenser according to claim 1, wherein the dispenser comprises at least one hinge arrangement having a first hinge member formed integrally with an interior of the cover, and a second hinge member formed integrally with an interior of a body of the dispenser, such that at least one hinge arrangement is concealed in a closed state of the dispenser.

24. The dispenser according to claim 23, wherein the hinge arrangement comprises a vertical pivoting axis enabling the cover to be pivoted sideways during opening and closing of the dispenser.

25. The dispenser according to claim 1, wherein each of the rear wall, the side walls, the front wall, and the upper wall is made at least partly of plastic material.

26. The dispenser according to claim 1, wherein the cover forms at least part of the front wall and at least part of the upper wall of the dispenser, and the cover extends over an entire width of the dispenser.

27. The dispenser according to claim 1, wherein the dispenser is arranged to be permanently mounted with its rear wall to a vertical wall, or as a stand-alone dispenser suitable for being positioned on a horizontal surface.

28. The dispenser according to claim 1, wherein the dispenser is arranged to dispense tissue sheets from a stack of sheets or a roll, or liquid or viscous materials.

29. A method for manufacturing a dispenser comprising:

forming a dispenser made mainly of plastic material, the dispenser comprising, in a closed state:

a rear wall, two opposite side walls, a front wall, an upper wall, a dispensing opening, and an openable cover that may be opened for refill of the dispenser, wherein the walls of the dispenser are made at least mainly of plastic material, cutting and forming a metal sheet, such that the metal sheet comprises a curved surface having a first radius of curvature in at least one direction and the metal sheet comprises at least one folded side edge forming a double-layered side edge, and laminating the metal sheet to a portion, but not all of, an exterior surface of the walls.

30. The dispenser according to claim 2, wherein the metal sheet further comprises a corner region having a second radius of curvature smaller than the first radius of curvature.

* * * * *